US010975569B1

(12) United States Patent
Haas

(10) Patent No.: US 10,975,569 B1
(45) Date of Patent: Apr. 13, 2021

(54) CONTINUOUS RAIL, DROP CEILING SYSTEM AND COMPONENTS

(71) Applicant: Gaylen A. Haas, Menasha, WI (US)

(72) Inventor: Gaylen A. Haas, Menasha, WI (US)

(73) Assignee: Gaylen A. Haas, Menasha, WI (US)

( * ) Notice: Subject to any disclaimer, the term of this patent is extended or adjusted under 35 U.S.C. 154(b) by 0 days.

(21) Appl. No.: 16/692,982

(22) Filed: Nov. 22, 2019

(51) Int. Cl.

| | |
|---|---|
| ***E04C 2/42*** | (2006.01) |
| ***E04B 9/12*** | (2006.01) |
| ***E04B 9/06*** | (2006.01) |
| ***E04B 9/28*** | (2006.01) |
| ***E04B 9/10*** | (2006.01) |

(52) U.S. Cl.
CPC ..... *E04B 9/122* (2013.01); *E04B 9/068* (2013.01); *E04B 9/10* (2013.01); *E04B 9/127* (2013.01); *E04B 9/28* (2013.01)

(58) Field of Classification Search
CPC . E04D 3/366; E04D 3/364; E04C 2/08; E04B 9/0478; E04B 9/0435; E04B 9/22; E04B 9/064; E04B 9/04; E04B 9/36; E04B 9/34; E04B 9/10; E04B 9/225; E04B 9/0464; E04B 9/067; E04B 9/241; E04B 9/26
USPC ..... 52/283, 578, 716.8, 717.06, 474, 478, 52/588.1, 542, 664, 506.1, 519, 520, 535, 52/536, 483.1, 482, 716.7; 248/250
See application file for complete search history.

(56) References Cited

U.S. PATENT DOCUMENTS

| | | | | |
|---|---|---|---|---|
| 2,303,271 A | | 11/1942 | Haertel | |
| 3,251,164 A | | 5/1966 | Wright | |
| 3,832,816 A | | 9/1974 | Jahn | |
| 4,091,588 A | | 5/1978 | Heirich | |
| 4,189,888 A | | 2/1980 | Blitzer, Jr. | |
| 4,538,380 A | | 9/1985 | Colliander | |
| 4,736,564 A | | 4/1988 | Gailey | |
| 5,239,801 A | * | 8/1993 | Adams | E04B 9/0478 52/506.07 |
| 5,609,007 A | | 3/1997 | Eichner | |

(Continued)

FOREIGN PATENT DOCUMENTS

| | | |
|---|---|---|
| CA | 1045774 | 1/1979 |
| WO | WO2004/005641 | 1/2004 |

OTHER PUBLICATIONS

Search Report and Written Opinion for PCT Application No. PCT/US2020/061154, "Continuous Rail, Drop Ceiling System and Components" dated Dec. 20, 2020.

*Primary Examiner* — Chi Q Nguyen

(57) ABSTRACT

An improved drop/suspended ceiling system which provides consistent spacing between continuous, parallel support rails is described. The rails attach directly to floor joists which permits locating ceiling panels as high as possible with respect to the bottom of the joists. In other embodiments, the rails may be supported by hangers, but held in parallel by spacers hidden by the ceiling panels to avoid the use of conventional suspended ceiling cross-sectional members. In some embodiments, the rails attach within or between joists and can also be used as a remodel or new option. Panels can be used with existing steel drop ceilings in conjunction with the spacer channel to achieve a continuous, parallel look with traditional steel drop ceiling rails using the spacer. Rails and tiles can serve as a direct replacement for traditional tiles or long panels can be used from wall to wall in isles or small rooms.

20 Claims, 16 Drawing Sheets

(56) References Cited

U.S. PATENT DOCUMENTS

| | | | | |
|---|---|---|---|---|
| 5,611,185 | A | 3/1997 | Wilz | |
| 6,205,732 | B1 | 3/2001 | Rebman | |
| 6,205,733 | B1 | 3/2001 | LaLonde | |
| 6,305,137 | B1 | 10/2001 | Rebman | |
| 6,314,698 | B1 | 11/2001 | Johansson | |
| 6,314,701 | B1 | 11/2001 | Meyerson | |
| 6,324,806 | B1 | 12/2001 | Rebman | |
| 6,338,228 | B1 | 1/2002 | Chevalier | |
| 6,536,173 | B2 | 3/2003 | Rebman | |
| 6,851,238 | B2 | 2/2005 | Rebman | |
| 6,892,500 | B2 | 5/2005 | Zaborowski | |
| 7,007,437 | B2 | 3/2006 | Thomas | |
| 7,010,894 | B1 * | 3/2006 | Cappelle | E04B 9/26 52/384 |
| 7,051,485 | B2 | 5/2006 | Burnette | |
| 7,841,149 | B2 | 11/2010 | Jahn et al. | |
| 9,353,522 | B2 | 5/2016 | Bergman et al. | |
| 9,771,717 | B1 | 9/2017 | Burnette | |
| 2006/0075710 | A1 * | 4/2006 | Maley | E04B 9/064 52/506.01 |
| 2007/0234673 | A1 * | 10/2007 | Helmus | E04B 9/02 52/506.07 |
| 2009/0188175 | A1 * | 7/2009 | Waters | E04B 9/064 52/74 |
| 2010/0229475 | A1 * | 9/2010 | Myers | E04B 9/10 52/173.1 |
| 2010/0284185 | A1 * | 11/2010 | Ngai | E04B 9/0464 362/235 |
| 2011/0072744 | A1 * | 3/2011 | Maley | E04F 19/022 52/220.1 |
| 2013/0047541 | A1 * | 2/2013 | Mayer | E04B 9/065 52/506.05 |
| 2013/0067633 | A1 * | 3/2013 | Salem | A41D 13/1245 2/102 |
| 2019/0112809 | A1 * | 4/2019 | Frantz | F24F 5/0021 |

* cited by examiner

CONTINUOUS RAIL, DROP CEILING SYSTEM AND COMPONENTS

BACKGROUND OF THE INVENTION

The present invention relates to a drop ceiling system and components thereof. In particular, the present invention related to providing ceiling rail spacing with structure which is not visible after the ceiling is installed. The present invention also relates to a system which permits the positioning of ceiling tiles above associated, supporting joist.

SUMMARY OF THE INVENTION

One embodiment of the invention relates to a continuous rail drop ceiling system.

The system includes a plurality of support rails supportable parallel to each other and relative to a building structure. Each rail includes a plurality of rail sections having an elongated cover extending between first and second ends along a central longitudinal axis. The width of the rails sections is defined by and extends between parallel first and second channels which extend parallel to the longitudinal axis between the first and second ends. The system also includes a first hanger rail having a first cross-section defined by a first leg engaged and slidable within the first channel and a second leg perpendicular to the first leg. Similarly, a second hanger rail is provided with a cross-section substantially the same as the first cross-section wherein the first leg of the second hanger is engaged and slidable within the second channel and the second leg of the second hanger is parallel to the second leg of the first hanger. A planar joint connector engages the first and second channels of the elongated covers of the adjacent ends of rail sections located such that the central longitudinal axes of the elongated covers are aligned in a collinear orientation, wherein the channels of the covers each include a ceiling panel support surface adjacent and perpendicular to a respective second leg of a respective hanger.

Another embodiment of the invention also relates to a drop ceiling system installed between the interior walls of the building to define an interior ceiling of the building. The system includes a plurality of support rails having a generally T-shaped cross section having a first flange and a central flange having hanger openings and an engagement flange. A plurality of hangers support the rails relative to the building. A plurality of elongated rail spacers are also provided and each includes a first flange engager and a second flange engager. The rail spacers are spaced along, and perpendicular to adjacent support rails and engaged with the respective engagement flanges to maintain a parallel and consistent spacing between adjacent support rails. The system also includes a plurality of ceiling panels supported between adjacent rails by the respective first flanges such that ceiling panels adjacent to rail spacers are located between the respective rail spacers and the respective first flanges to prevent visibility of the rail spacers from below the interior ceiling.

Another embodiment of the invention relates to a ceiling installed between the interior walls of the building to define an interior ceiling of the building. The ceiling includes a plurality of support rails supported parallel to each other and relative to a building structure. Each support rail includes a plurality of sections. The rail sections include an elongated cover extending between first and second ends along a central longitudinal axis, the cover having a width extending between parallel interior facing first and second channels which extend parallel to the longitudinal axis between the first and second ends. The rail sections further include first and second hanger rails having similar cross sections defined by a first leg engaged with and slidable within a respective interior facing channel and a second leg perpendicular to the respective first leg. The second legs are attached to opposite sides of a joist positioned there between. A planar joint connector is engaged with the respective first and second channels of the elongated covers of the adjacent ends of rail sections located such that the central longitudinal axes of the elongated covers are aligned in a collinear orientation, wherein the channels of the covers each include a ceiling panel support surface adjacent and perpendicular to a respective second leg of a respective hanger. A plurality of ceiling panels extend along a panel longitudinal axis extending between first and second panel ends each panel having a U-shaped cross section defined by a planar portion extending between parallel legs parallel to the panel longitudinal axis and perpendicular to the flat portion. The panels being supported at the panel ends by respective panel support surfaces of the respective elongated covers between the joist and above the bottoms of the joists.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, various embodiments of a continuous drop ceiling are shown. A drop ceiling is described in various embodiments that couples directly to a floor joist to reduce the ceiling profile and increase the volume of a room interior. In this description, floor "joist" will be used to refer to a truss or frame, for example a floor or ceiling truss. This configuration enhances the construction and facilitates installation, in addition to providing an open room with a ceiling that abuts the floor joists overhead. In some embodiments, panels are formed with double side tape adhesives to customize the size and shape of the panel. For example, the panels can be modified to fit in standard drop ceiling grid systems, or customized to fit in a particular, "one off" circumstance. In this way, the panels are suitable for commercial and/or residential drop ceiling applications and can be used in traditional or standard drop ceiling grid systems (e.g., to replace a worn-out tile).

In some embodiments, the cover is constructed of lightweight materials and configured to adjustably couple to joist hangars with standard widths (e.g., 2' or 4' apart). A ceiling panel spaces and/or snap lock design can be used to accommodate modifications or non-standard designs. Similarly, panels can be adjusted for fit tight configurations, such as in an isle or small room and can be quickly installed where ceiling support is not required. A click part design can be used to secure an internal rail to the joist/truss and an external rail is then coupled to the internal rail to support the panels. Joint connectors can be inserted into the end slots of the support rails to customize the length of the rail supporting the panels. In this way, the design contributes a fast and efficient way to construct a ceiling while reducing the space necessary for the construction. This has the effect of "opening" the room interior and providing a ceiling that minimizes the wasted space between the ceiling tiles and the floor joists.

Figure 1:
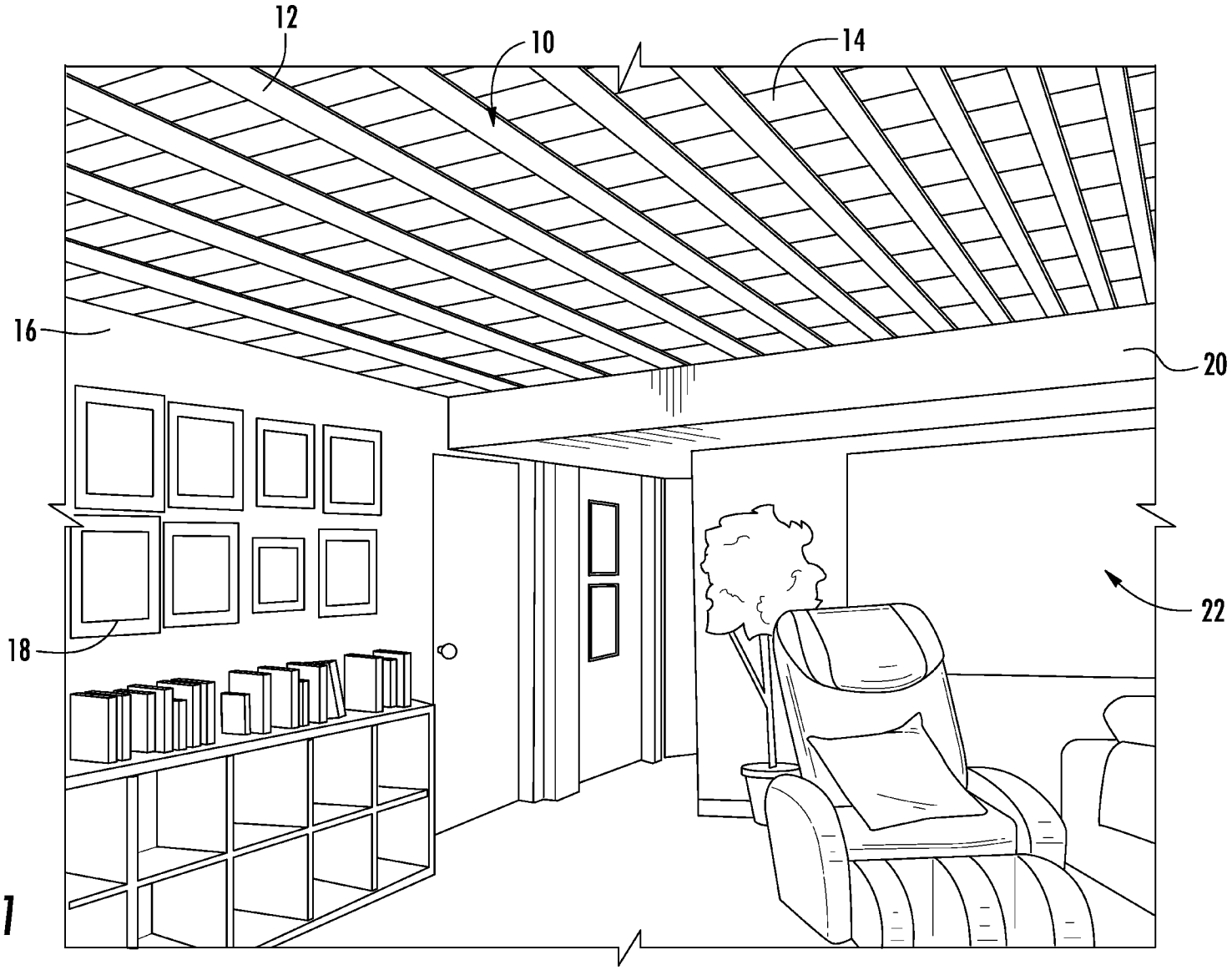
FIG. 1 is a perspective view of a portion of a drop ceiling viewed from below the ceiling.

FIG. 1 illustrates a room 22 with an installed continuous drop ceiling 10 assembly, according to an exemplary embodiment. Drop ceiling 10 includes a plurality of support rails 12 (e.g., supporting assemblies of support rails 12) in parallel to each other and a plurality of ceiling panels 14 between support rails 12 oriented in a generally perpendicular direction relative to support rails 12 and parallel to adjacent ceiling panels 14. Together support rails 12 and ceiling panels 14 form an aesthetically pleasing drop ceiling 10 that, in some embodiments, abuts or is adjacent to the floor to maximize the interior volume or space available.

Wall joints or trim 16 (e.g., an L, C, or T-shaped bracket depending on installation type) are also illustrated in FIG. 1. This configuration enables the ceiling panels 14 to abut a wall 18 or seamlessly join to an existing ceiling configuration 20. As shown in the figure, the existing ceiling configuration may be lower than the drop ceiling 10 due to the need to accommodate the floor joists and the construction materials used to form the existing ceiling configuration 20. However, this illustration shows how the drop ceiling 10 can be easily modified or customized for different ceiling applications and configured to work with traditional existing ceiling configurations 20 or used in a standard or customized ceiling configuration 20. As shown in FIG. 1, drop ceiling 10 increases the space or internal volume of a room 22 as compared to a standard or traditional drop ceiling configuration 20.

Figure 2:
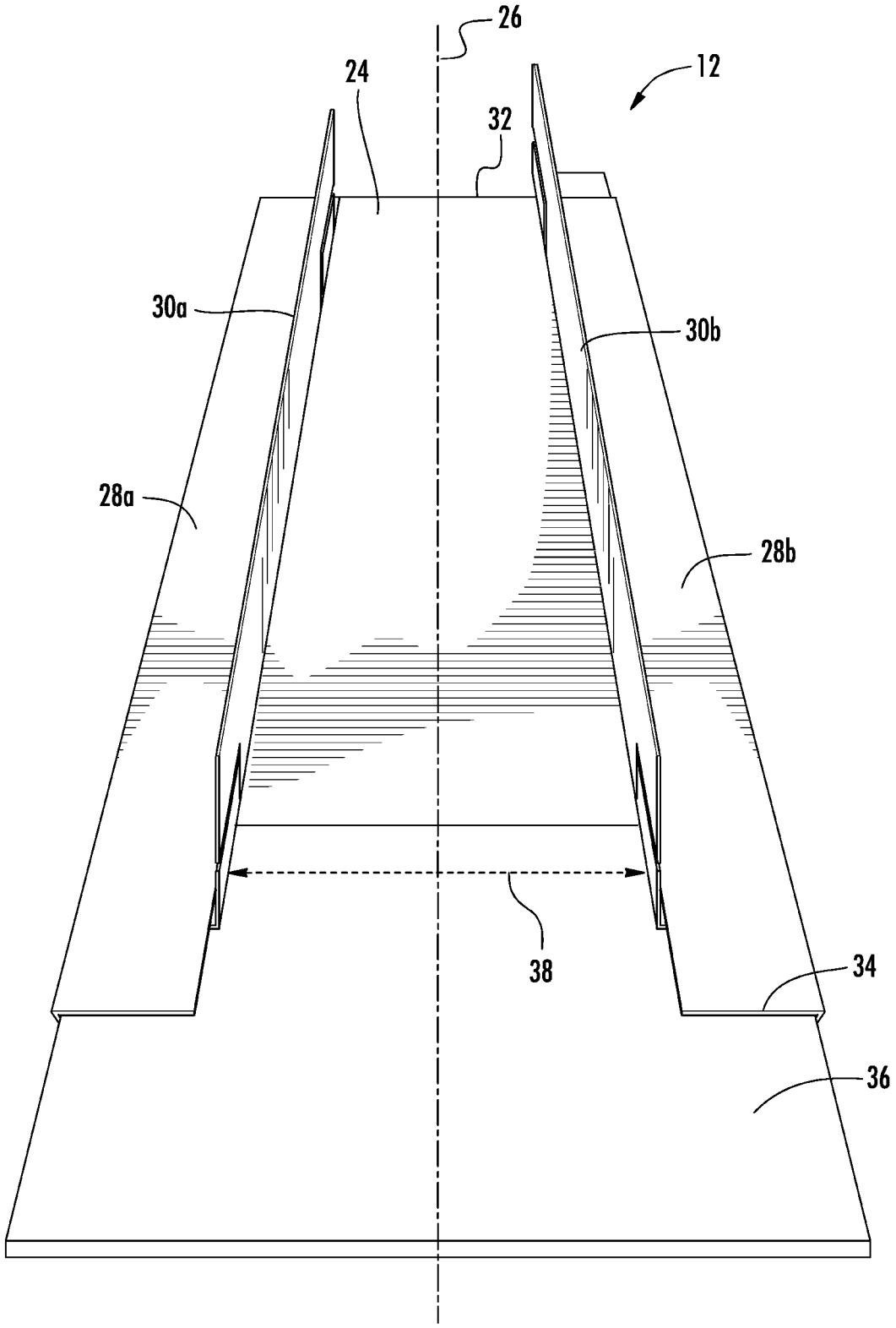
FIG. 2 is a partial, end sectional view of a drop ceiling with the sectional view taken perpendicular to the ceiling support rails.
Figure 3:
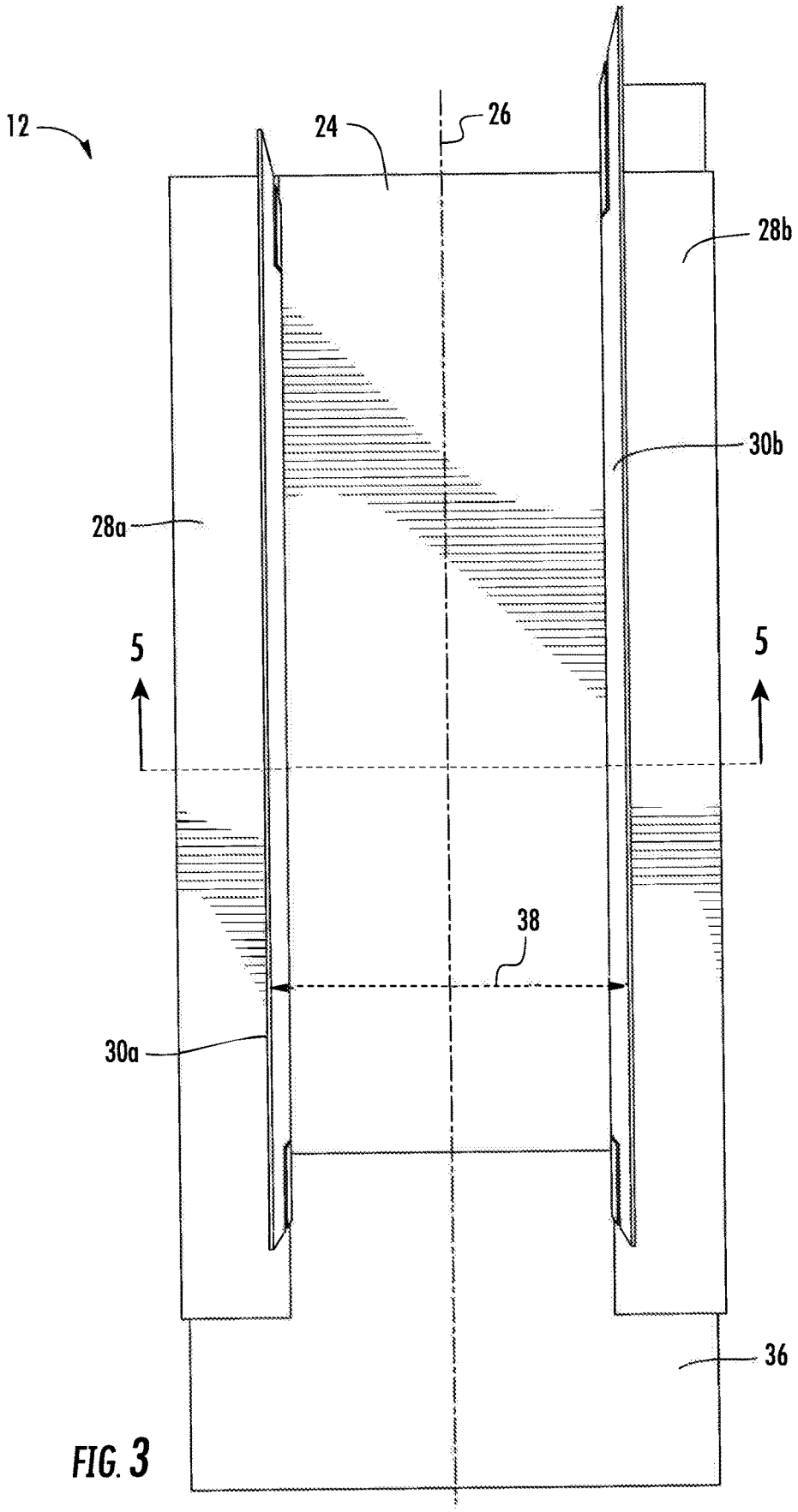
FIG. 3 is a partial, end sectional view of a drop ceiling with the sectional view taken parallel to the ceiling support rails, this also includes the joint connector part.

FIGS. 2-3 illustrate a partial end sectional view of a drop ceiling 10 support rail 12 to provide more detail on the construction of the support rail 12, according to one embodiment. Support rail 12 includes a cover 24 extending along a central longitudinal axis 26. Cover 24 includes two channels 28, e.g., a first or left channel 28*a* and a second or right channel 28*b*. Except where necessary to differentiate the first and second channels 28*a* and 28*b*, general reference in the description will be made to channel 28. Channels 28 receive a portion of ceiling support rails or left and right hangar rails 30*a* and 30*b* (generally referred to as hangar rail(s) 30) that extend along the central longitudinal axis from a first or far end 32 to a second or near end 34 of cover 24. In some embodiments, hangar rails 30 extend the whole length of cover 24. In other embodiments, hangar rails 30 extend part-way along left and/or right channels 28 of cover 24. In some embodiments, a planar joint connecter 36 is inserted in the far end 32 and/or near end 34 to couple one cover 24 to an adjacent cover 24, e.g., to form a continuous support rail 12 and to increase the total length of support rail 12. As shown in FIGS. 2-3, planar joint connecter 36 may fit under hangar rails 30, or in other embodiments, planar joint connecter 36 may abut an end of hangar rails 30 or be inserted into an end slot of hanger rails 30, for example, depending on the installation type and/or design.

FIG. 3 is a top view of the ceiling support rail of FIG. 2 illustrating hangar rails 30 within the left and right channels 28 and oriented parallel to the other hangar rail 30. Support rails 12 include two hangar rails 30 that can slide within left and right channels 28 of cover 24 to form a variable attachment width 38, e.g., to connect the hangar rails 30 to a floor joist or other ceiling structure. In other words, the variable attachment width 38 changes to allow support rail 12 to couple to a variety of different sized floor joists or other structures. The adjustable hangar rails 30 also enable cover 24 to couple to imperfect, inconsistent, or otherwise non-standard floor joists and trusses widths while not deflecting the cover 24. For example, the completed cover 24 over an inconsistent truss width will have the same or similar aesthetic appearance as a cover 24 over a traditionally sized truss. In addition, as shown in FIG. 3, planar joint connecter 36 creates an extension joint that couples one cover 24 to an adjacent cover 24 to extend the total length of the support rail 12*y*. For example, planar joint connecters 36 can couple to any number of covers 24 to completely extend support rails 12 over any size or dimension of drop ceiling 10. Similarly, different sized covers 24 may be used to configure the support rail 12 to any custom configuration.

Figure 4:
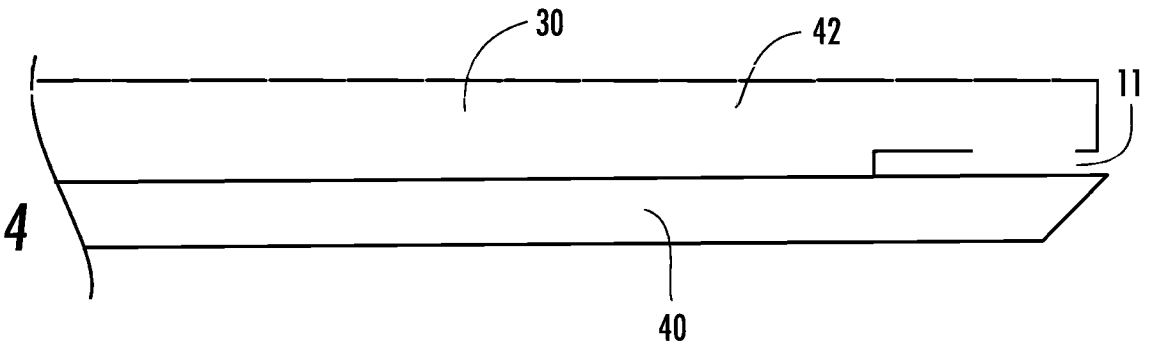
FIG. 4 shows a support rail with end slot that inserts into wall trim.

FIG. 4 shows a hangar rail 30 with hanging leg and supporting leg 40. As shown in FIG. 4, hangar rail 30 includes a female slot 11 at one end. Female slot 11 facilitates coupling of hangar rail 30 and/or support rail 12 to either an adjacent support rail 12 or wall trim 16 in a room 22. For example, female slot 11 fits over, under, or between a ledge on wall trim 16 or planar joint connecter 36.

Figure 5:
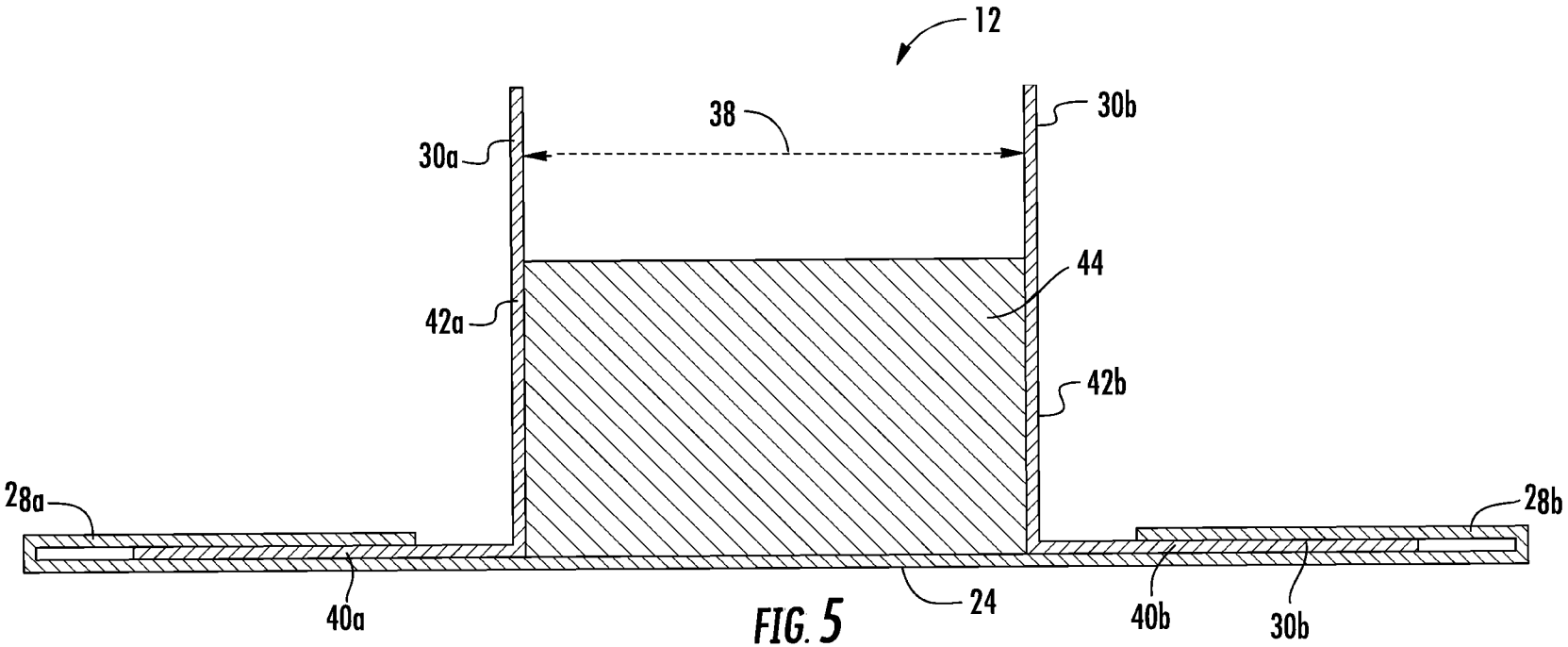
FIG. 5 is a perspective view of a rail section and associated joint connector.

FIG. 5 illustrates aspects of the support rail 12 at a cross-section taken at line 5-5 of FIG. 3. As illustrated in FIG. 5, cover 24 includes a left channel 28*a* and right channel 28*b* that each partially receive a corresponding hangar rail 30*a* and 30*b*, respectively. Specifically, a supporting leg 40 (e.g., left and right supporting legs 40*a* and 40*b*) of each hangar rail 30 slidably couples within opposing channels 28 of cover 24. In other words, each hangar rail 30 includes a hanging leg 42 and support leg 40. In this way, hanging legs 42 couple the support rail assembly to a joist 44. For example, a nail, staple, double-sided tape, adhesive, or screw passes through hanging legs 42*a* and/or 42*b* and into joist 44 to support each supporting leg 40*a* and/or 40*b*. Each supporting leg 40 is slidably coupled under left and right channels 28 of cover 24. Support rail 12 allows for variable widths 38 between the hangar rails 30 to accommodate different sized (e.g., imperfect and/or inconsistent or inconsistent over truss plates) floor joists 44 and/or other sized structure at the time of assembly, while also providing a secure location (e.g., on top of the left and right channels 28) to secure a plurality of ceiling panels 14.

Figure 6:
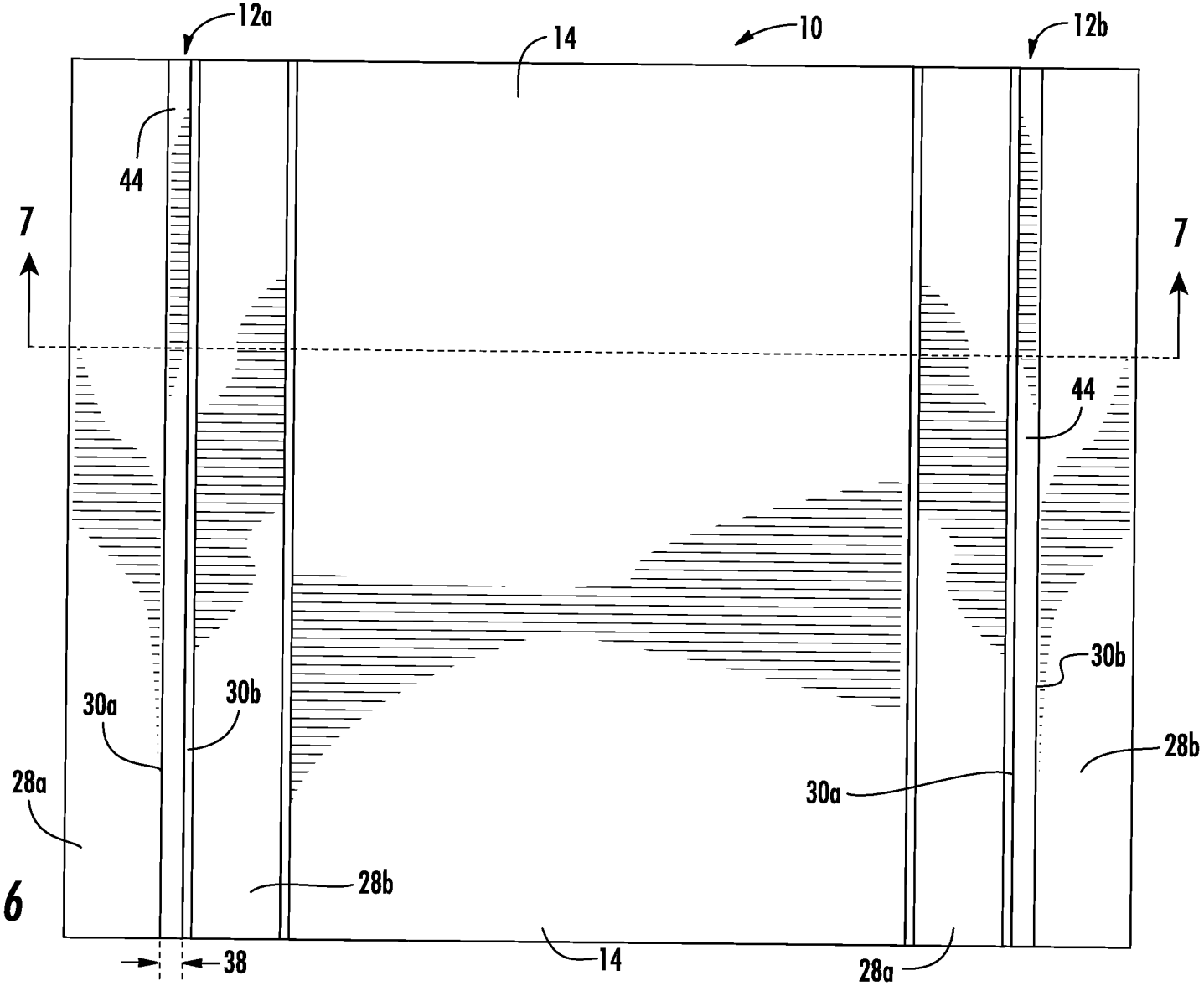
FIG. 6 is a top view of a rail section and associated joint connector.
Figure 7:
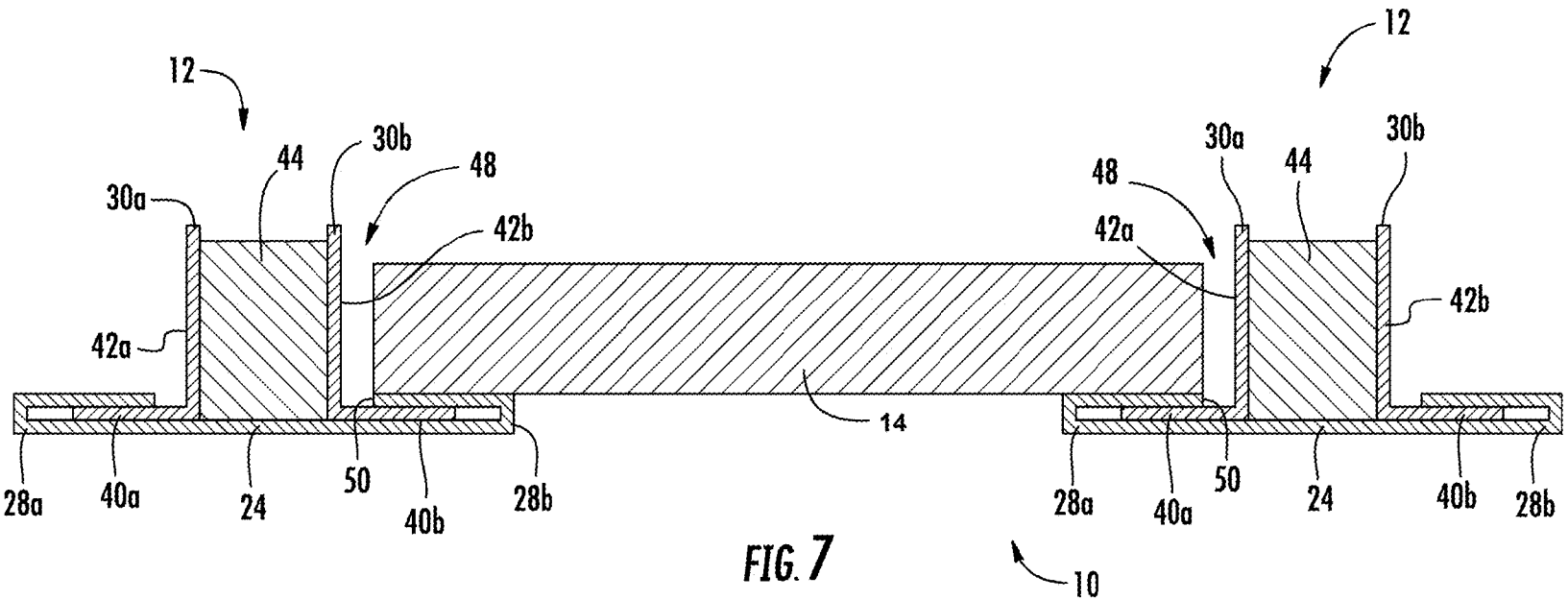
FIG. 7 is a sectional view of the rail section taken along line 7-7 in FIG. 6.
Figure 12:
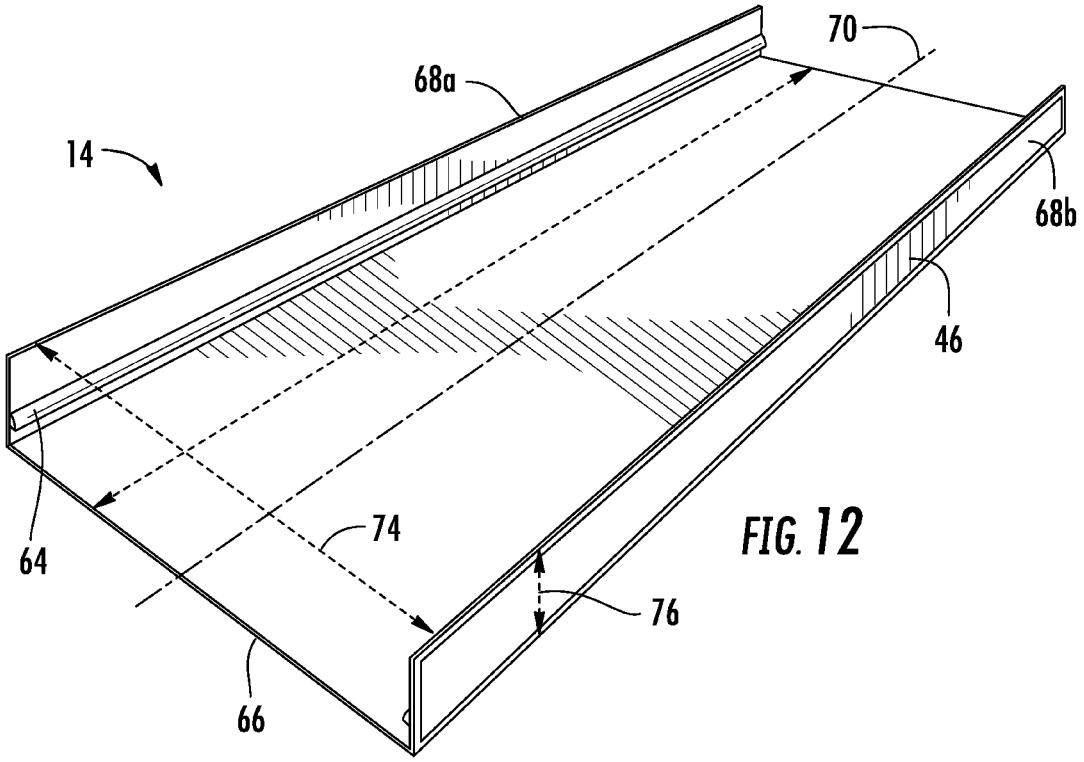
FIG. 12 is a perspective view of a U-shaped ceiling panel.
Figure 13A:
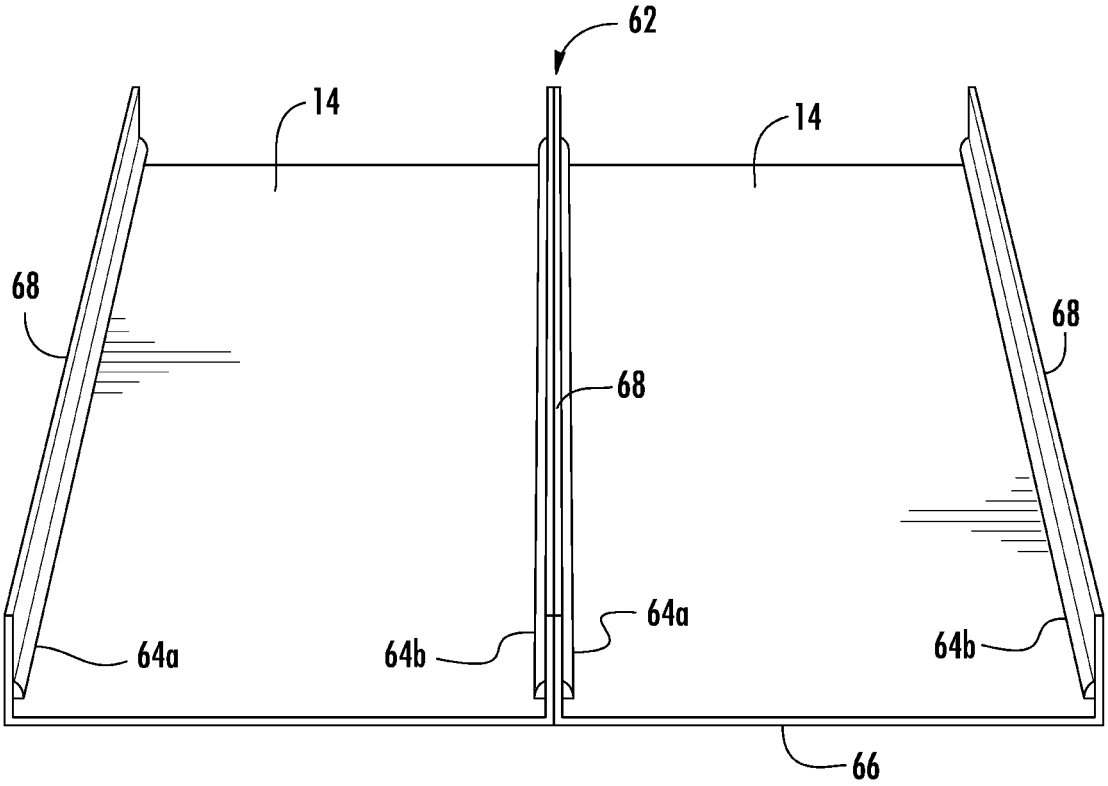
FIG. 13A is an end view of two panels adhered together with two-sided tape located between the adjacent parallel legs.
Figure 13B:
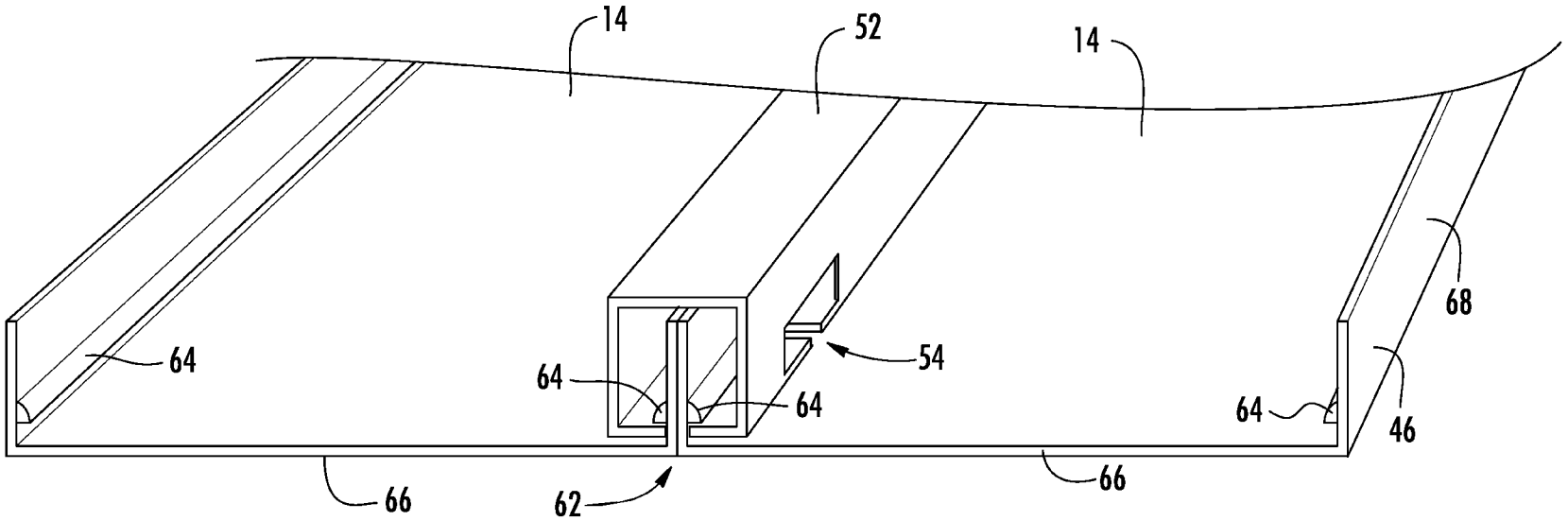
FIG. 13B is a perspective view of two panels adhered together with a spacer member.

FIGS. 6 and 7 illustrate a completed drop ceiling 10. As shown in FIG. 6, variable widths 38 of each supporting rail 12 couple to a variety of standard or non-standard (e.g., imperfect and/or inconsistent) sized joists 44. Ceiling panels 14 extend from right channel 28*b* of one supporting rail 12*a* (e.g., a left support rail 12*a*) to the left channel 28*a* of an adjacent and parallel supporting rail 12*b* (e.g., a right support rail 12*b*). A cross section of drop ceiling 10, taken at line 7-7 of FIG. 6 and shown in FIG. 7, is taken through a joint between two ceiling panels 14 to illustrate the coupling of parallel adjacent ceiling panels 14 substantially perpendicular to support rails 12. As shown in FIG. 12, an adhesive 46 may be placed in between the joint of two ceiling panels 14 to secure the ceiling panels 14 relative to one another and provide the drop ceiling 10 a uniform aesthetic appearance. In some embodiments, adhesive 46 is a double sided tape, glue, tack, rubber, epoxy, nail, clinch, or screw. In the configuration of FIG. 13B, each ceiling panel 14 or tile includes matching detents and indents (e.g., tabs and slots) to slidably couple adjacent ceiling panels 14.

As further illustrated in FIG. 7, gaps 48 may form between ends of ceiling panels 14 and joists 44 due to the variable widths 38 of each support rail 12. For example, as shown in FIG. 7, gaps 48 align an inner edge 50 of each channel 28 to the length of ceiling panel 14 to enable drop ceiling 10 to accommodate any variable width 38 or joist 44. For example, a standard size ceiling tile aligns with a standard configuration of floor joists 44 such that gaps 48 align with inner edges 50 of each channel 28. However, a deviation to either the spacing of floor joists 44 and/or a width of floor joists 44 is accommodated by gaps 48 and/or the length of channels 28. The adjustable rails enables cover 24 to be coupled to an imperfect and/or inconsistent floor truss or joist 44 with variable widths without deflecting the installed cover 24.

Figure 8:
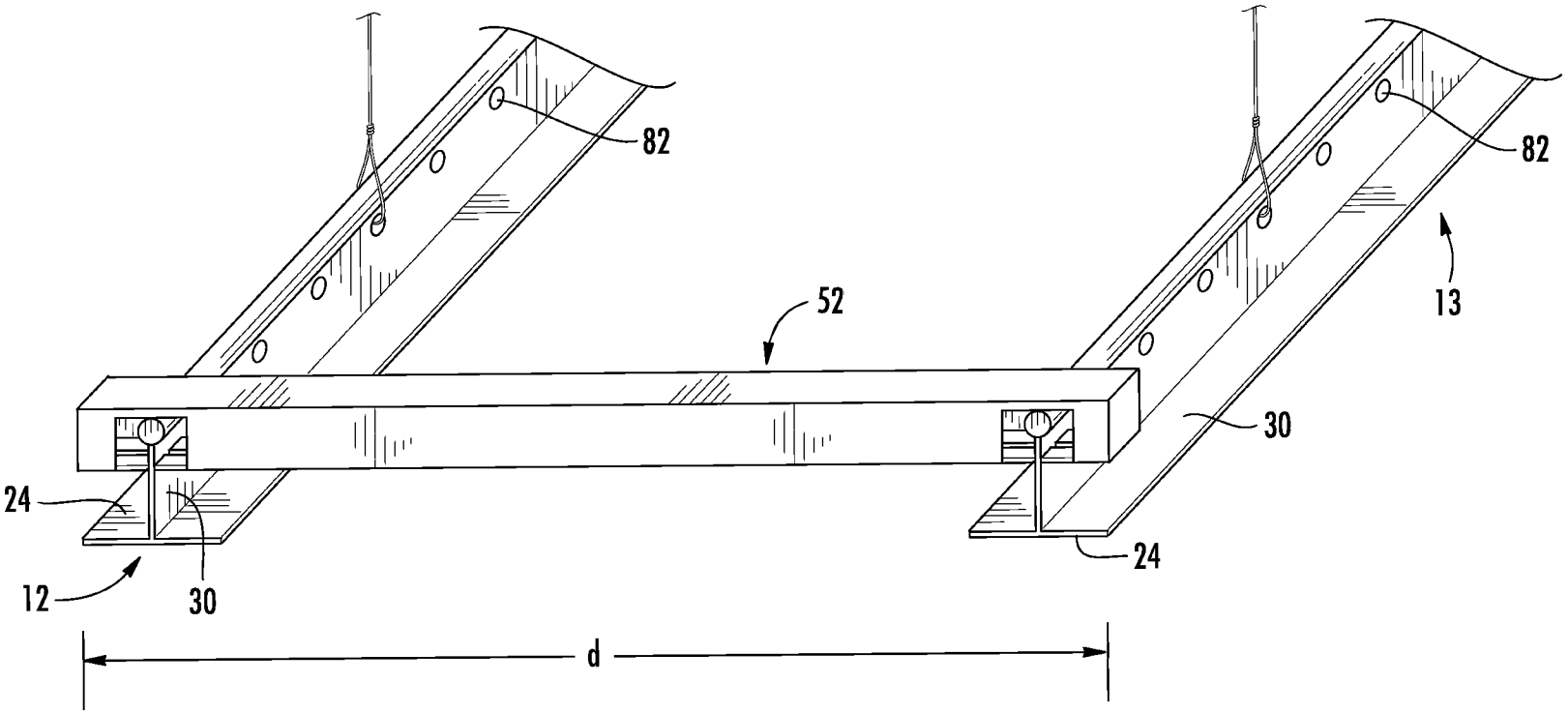
FIG. 8 is a side view of a hangar rail showing a slot on the rail.

FIG. 8 shows a spacer 52 between a traditional steel drop ceiling rail 13 and support rail 12 of the present application. As shown, spacer 52 maintains a distance d between rails 12 and 13 so that the rails are kept parallel and equidistant. Distance d can be customized for a particular application, e.g., non-standard, or can be a standard distance, d. For example, is a standard distance of 2' (24") or 4' (48"). In other embodiments, distance d can be more or less than these values to customize the support rail 12 for the needs of the drop ceiling 10 system.

Figure 9:
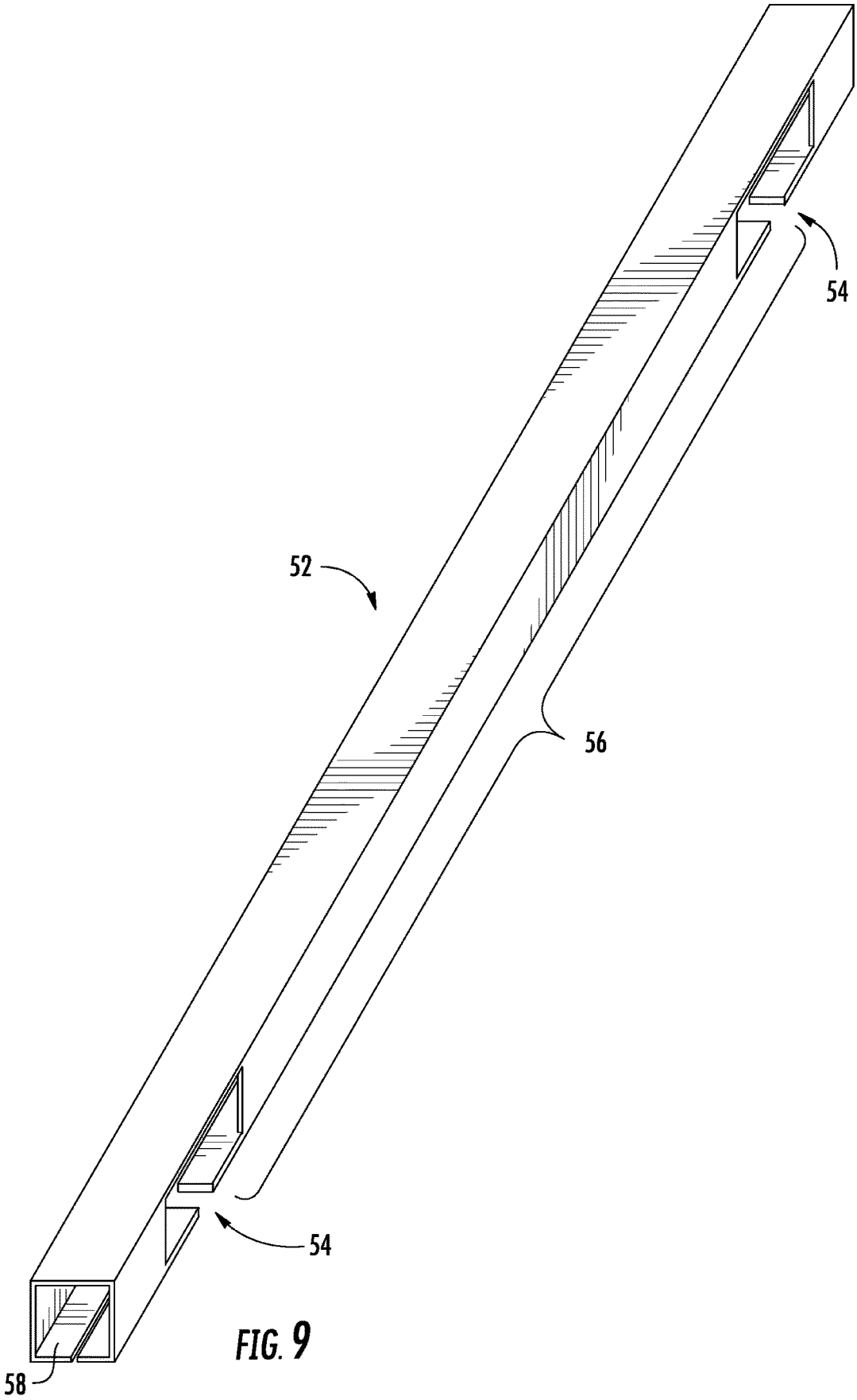
FIG. 9 is a perspective view of an elongated spacer member.

In some embodiments shown in FIG. 9, spacers 52 are used to keep support rails 12 equally spaced and/or parallel with adjacent support rails 12. Spacers 52 couple to support rails 12 at a pair of pockets 54 on either end of spacer 52. Slots 58 receive ceiling panels 14 to securely couple adjacent panels 14 relative to one another. As described above, a tile length 56 may be established for a traditional or standard length of ceiling panel 14 to offset or space parallel support rails 12 a predetermined length (e.g., so gaps 48 align with inner edges 50 of each cover 24). In this way, spacers 52 help keep ceiling panels 14 or tiles aligned to keep support rails 12 parallel and form a uniform appearance to drop ceiling 10. In addition, the depth and design of pockets 54 also accommodates the male end of a traditional steel drop ceiling rail 13. This spacer 52 keeps rails 12 and 13 parallel at a consistent 24" or 48" separation. In this way, ceiling panels 14 are used in conjunction with new installations or remodeled modifications of traditional steel drop ceiling rails 13. Similar configurations of spacer 52 apply to two traditional steel drop ceiling rails 13 and/or parallel support rails 12.

Figure 10:
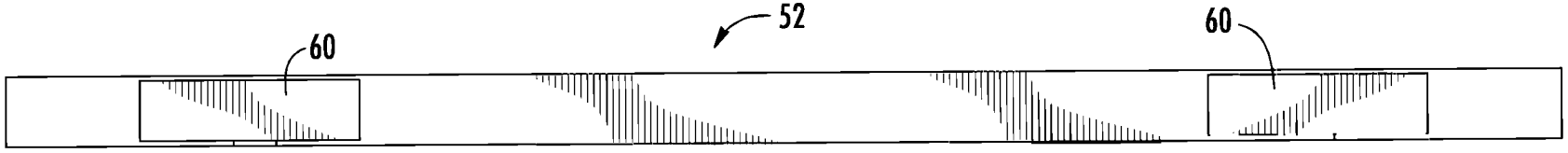
FIG. 10 is a side view of the elongated spacer member.
Figure 11:
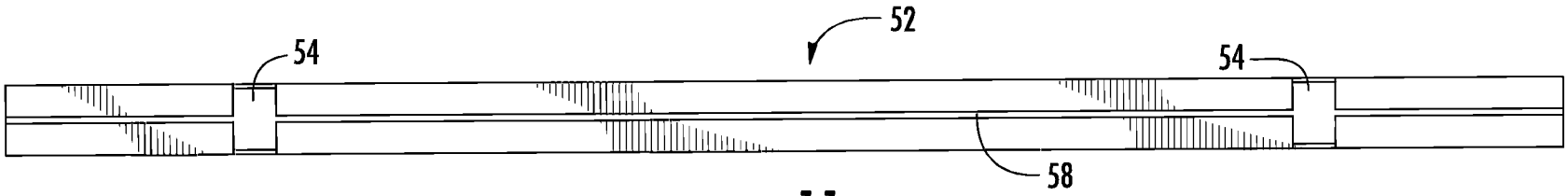
FIG. 11 is a bottom view of an elongated spacer member.

FIGS. 10 and 11 show top and bottom views of spacer 52, respectively. As shown from above in FIG. 10, view ports 60 may enable a user assembling the spacers on two adjacent and parallel support rail 12 to view the connection, e.g., within pocket 54. For example, a view port 60 helps ensure the assembly operator that the joint between spacer 52 and support rails 12 is secure, e.g., during construction of drop ceiling 10. As shown from below in FIG. 11, each spacer 52 includes pockets 54 on either end to couple to support rails 12 and a slot 58 that couples with two adjacent ceiling panels 14. For example, two ceiling panels 14 couple to form a joint 62 (FIGS. 13A and 13B). In some embodiments, ceiling panels 14 include a detent or ridge 64 (e.g., left ridge 64*a* and right ridge 64*b*) that when coupled with the ridge 64 on an adjacent ceiling panel 14, ridges 64*a* and 64*b* fit within slot 58 of spacer 52. Pockets 54 extend over an end of ceiling panels 14 and around ridges 64*a* and 64*b* to couple to and secure support rails 12. In this way, spacers 52 ensure equal spacing of ceiling panels 14 over drop ceiling 10.

FIG. 12 shows a perspective view of a single ceiling panel 14 as shown in FIG. 12, ceiling panel 14 may be U-shaped such that a base 66 is relatively flat and two sides 68 (e.g., left side 68*a* and right side 68*b*) extend in a perpendicular direction (e.g., upwards) away from base 66. In this application, U-shaped and C-shaped components differ in the orientation of the base. For example, the mid-section or base of a U-shaped component is substantially parallel to the ceiling or floor. The mid-section or base of a C-shaped component is substantially parallel to the wall. These conventions are illustrative only, and a person with ordinary skill would recognize the ability to re-orient a C or U shaped bracket or component (or L or T shaped brackets/components) based on the design parameters of the application.

In various embodiments, ceiling panel 14 is U-shaped and has a hollow or solid cross section. Base 66 of ceiling panel 14 extends along a transverse axis 70 that is perpendicular to the central longitudinal axis 26 of support rail 12. The female slot 11 (FIG. 4) at the end of rail 30 is inserted into wall support leg 80 to secure support rail 12 before and/or after securing hanger rails 30 to joist 44. Ceiling panel 14 extends along transverse axis 70 to define a length 72 and a width 74, e.g., that extends along the central longitudinal axis 26 of the support rail 12. A height 76 of each side 68 extends along the length 72 of ceiling panel 14 and defines the U-shape. Side 68 (e.g., extending along the length 72 and height 76) provides an area to couple adjacent ceiling panels 14 and form joint 62 (FIG. 13A). For example, adhesive 46 (e.g., dual sided tape) is disposed on adjacent ceiling panels 14 to couple ceiling panels 14 (e.g., adjacent tiles) together. In some embodiments, adhesive 46 is only disposed on one side of ceiling panel 14 such that each side of ceiling panel 14 with adhesive 46 is joined to an adjacent side without adhesive 46. Optionally, ridges 64 on each side 68 pair to an adjacent ceiling panel 14 to form joint 62. Joint 62 includes a pair of ridges 64 that fit within slot 58 of spacer 52.

As shown in FIG. 13B, spacer 52 fits over joint 62 and around the pair of ridges 64 to secure joint 62. Spacer 52 includes opposing pockets 54 that couple the pair of ceiling panels 14 to support rails 12 on either end, securing the ceiling panels 14 to the drop ceiling 10. In some embodiments, spacers 52 are fitted onto each joint 62 (e.g., two per ceiling panel 14). In various embodiments, different numbers of lengths and/or spacers 52 are used, for example, one spacer 52 per tile/panel 14 or every other joint 62, every third joint 62, every fourth joint 62, every fifth joint 62, or more. In some embodiments, spacers 52 are used to create standard sized assemblies (e.g., 4' by 2' [24" by 48"] or 2' by 2' [24" by 24"]). For example, a standard 4' by 2' assembly of ceiling tiles can be used to replace a damaged traditional 4' by 2' tile. In this way, ceiling panels 14 can be used with traditional support rails 12 to replace traditional worn or damaged tiled ceilings.

Figure 14:
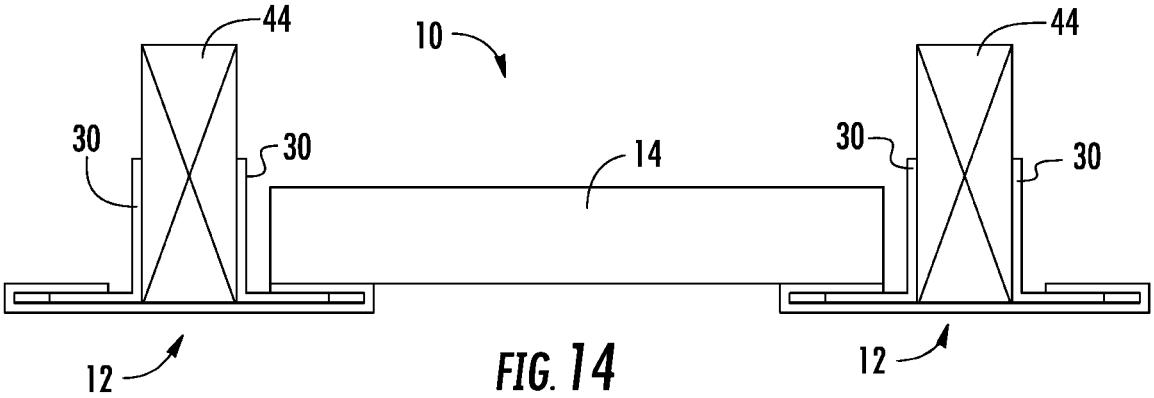
FIG. 14 is an end view of two floor joists of a building supporting two parallel rails and a ceiling panel supported by the rails between the floor joists and above the bottoms of the floor joists.

FIG. 14 shows an end view at the end of a joist 44 showing the connection to hangar rails 30 and cover 24 along joist 44. As shown, support rails 12 follow joist 44 to a joint adjacent to wall 18. Similarly, ceiling panel 14 abuts wall 18, and in some embodiments, adhesive 46 of ceiling panel 14 is applied to a surface of wall 18 to secure joint 62 between ceiling panel 14 and against wall 18. As shown in FIG. 14, drop ceiling 10 at an end is similar to drop ceiling 10 at a cross-section through a joint 62 at two ceiling panels 14, as illustrated in FIG. 7.

Figure 15:
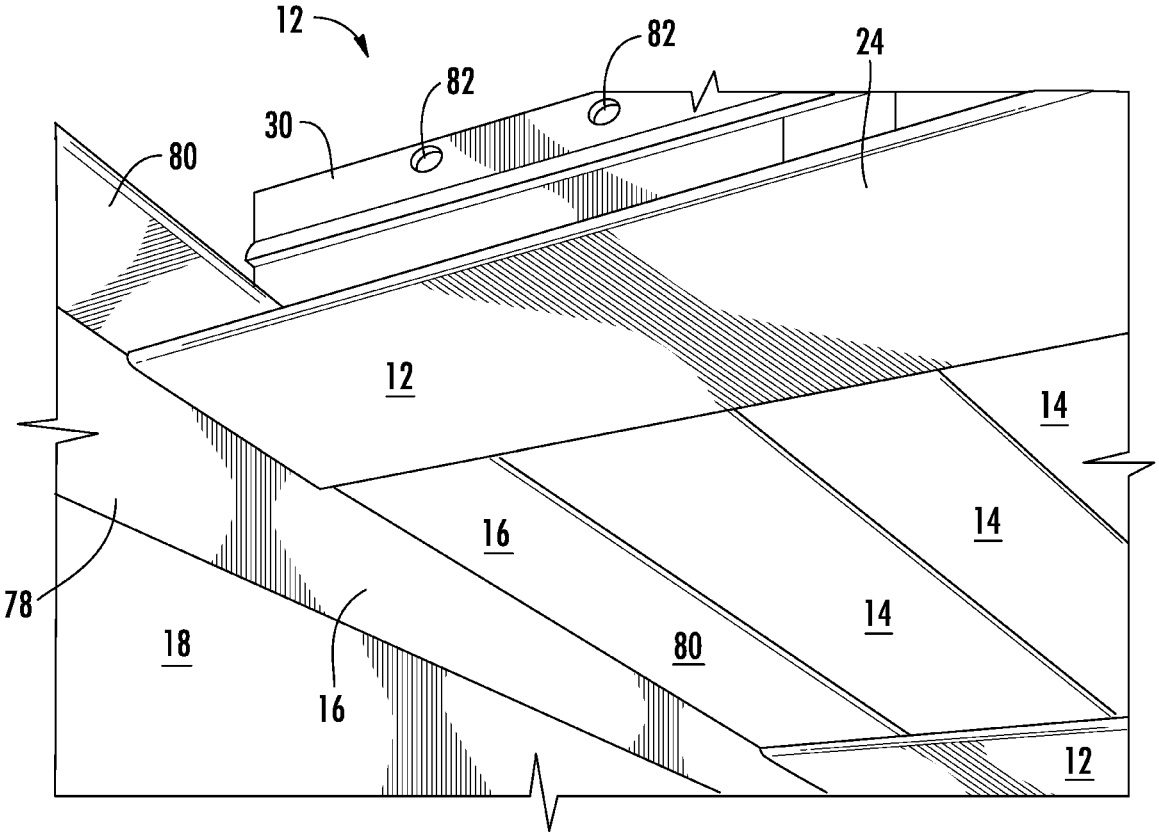
FIG. 15 is a side view of the interaction between a rail, a wall trim section, the wall, a floor joist and a ceiling panel wherein the rail is fastened directly to the floor joist.

FIG. 15 shows another method of joining an end (e.g., near end 34 or far end 32) of support rail 12 to a wall 18. As shown in FIG. 15, an L-shaped, C-shaped, or T-shaped bracket or wall trim 16 is coupled to wall 18 and provides an attachment leg 78 and a support leg 80. Other embodiments for wall trim 16 are contemplated. For example, wall trim 16 may include attachment leg 78 above cover 24 of support rail 12, such that attachment leg 78 is not visible to an observer in the interior space or room 22. In some embodiments, female slot 11 (FIG. 4) at the end of rail 30 is inserted into wall support leg 80 and secures support rail 12 before and/or after securing hanger rails 30 to joist 44. In addition, panel 14 can slide on top of support rail 12 and below support leg 80 to create a flush joint with attachment leg 78 at the wall 18. In this way, panel 14 creates a clean and finished edge at the wall 18 joint.

Figure 16:
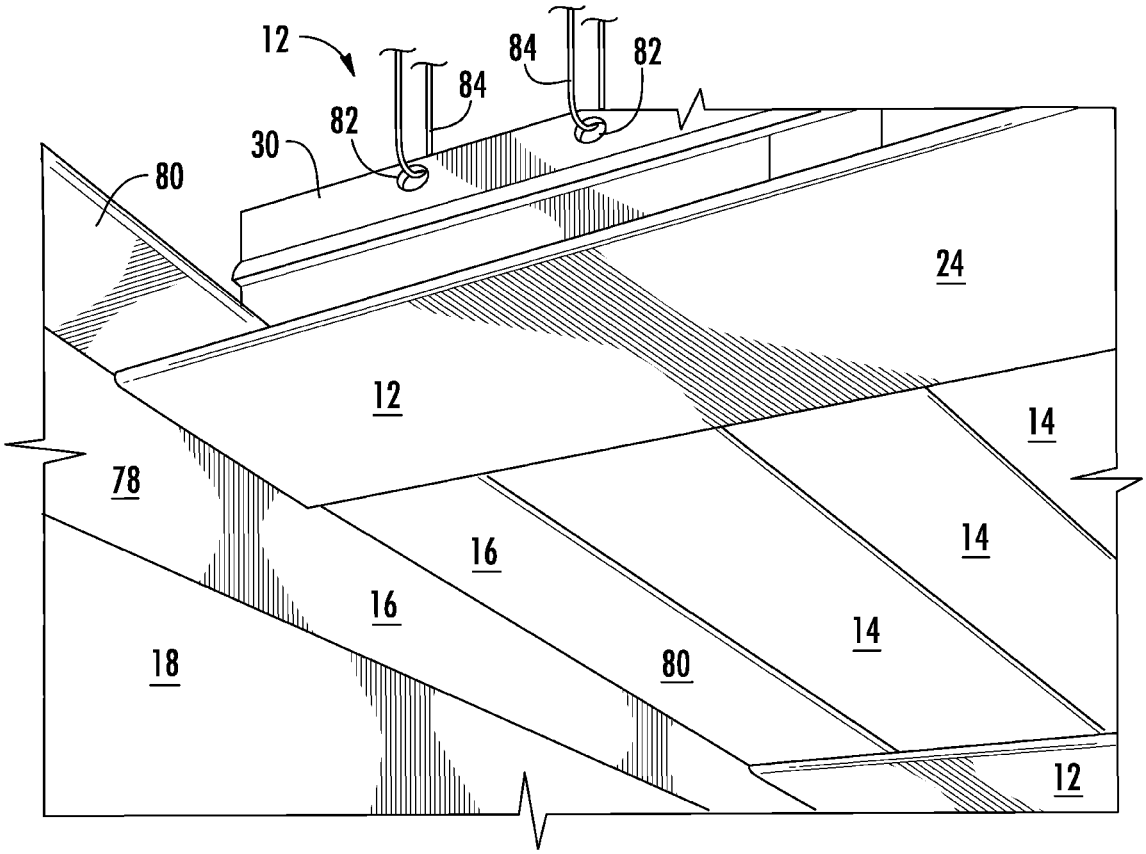
FIG. 16 is a side view of the interaction between a rail, a wall trim section, the wall, a floor joist and a ceiling panel wherein the rail supported by a rail hanger attached to the floor joist in a drop ceiling application.

Hangar rails 30 may include screw holes 82, as shown in FIG. 15. Screw holes 82 are used to insert a screw through hangar rails 30 to couple support rail 12 to joist 44. Similarly, holes 82 can use other methods of attaching or coupling support rail 12 to joists 44. As shown in FIG. 16, holes 82 can be used to pass a supporting thread, rope, or wire 84 that is connected to an overhead structure. In this way, holes 82 can be used to hang support rails 12 that support ceiling panels 14. In other words, drop ceiling 10 can be attached directly to joists 44 or indirection to other existing structures (e.g., through a wire 84 passing through holes 82 of hangar rail 30). In some embodiments of drop ceiling design, spacer 52 keeps support rail 12 and/or 110 two feet (24") to four feet (48") apart to accept panel 14 evenly and consistently.

Figure 17:
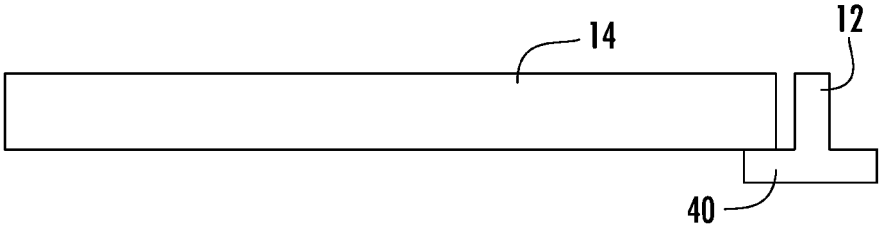
FIG. 17 is a conventional ceiling panel which includes a T-cross section cross member joined to the ceiling panel to hide the seam between adjacent ceiling panels.

FIG. 17 is a schematic view of a support rail 12 supporting a ceiling panel 14. This view shows the cantilever support provided by the support rail 12 at each channel. FIG. 17 also indicates how a balanced support rail 12 supporting equal numbers of ceiling panels 14 on either side of the rail 12 will balance the cantilever reactions on the supporting rail 12 and balancing the system. In other words, a support rail 12 with equal number of ceiling panels 14 on either side of the rail 12 needs only provide a supporting tensile force through the support leg 40 of hangar rail 30, whereas an unbalanced support rail 12 (e.g., with unequal numbers of ceiling panels 14 on either side of rail 12), also balances a moment at support leg 40 of hangar rail 30.

Figure 18:
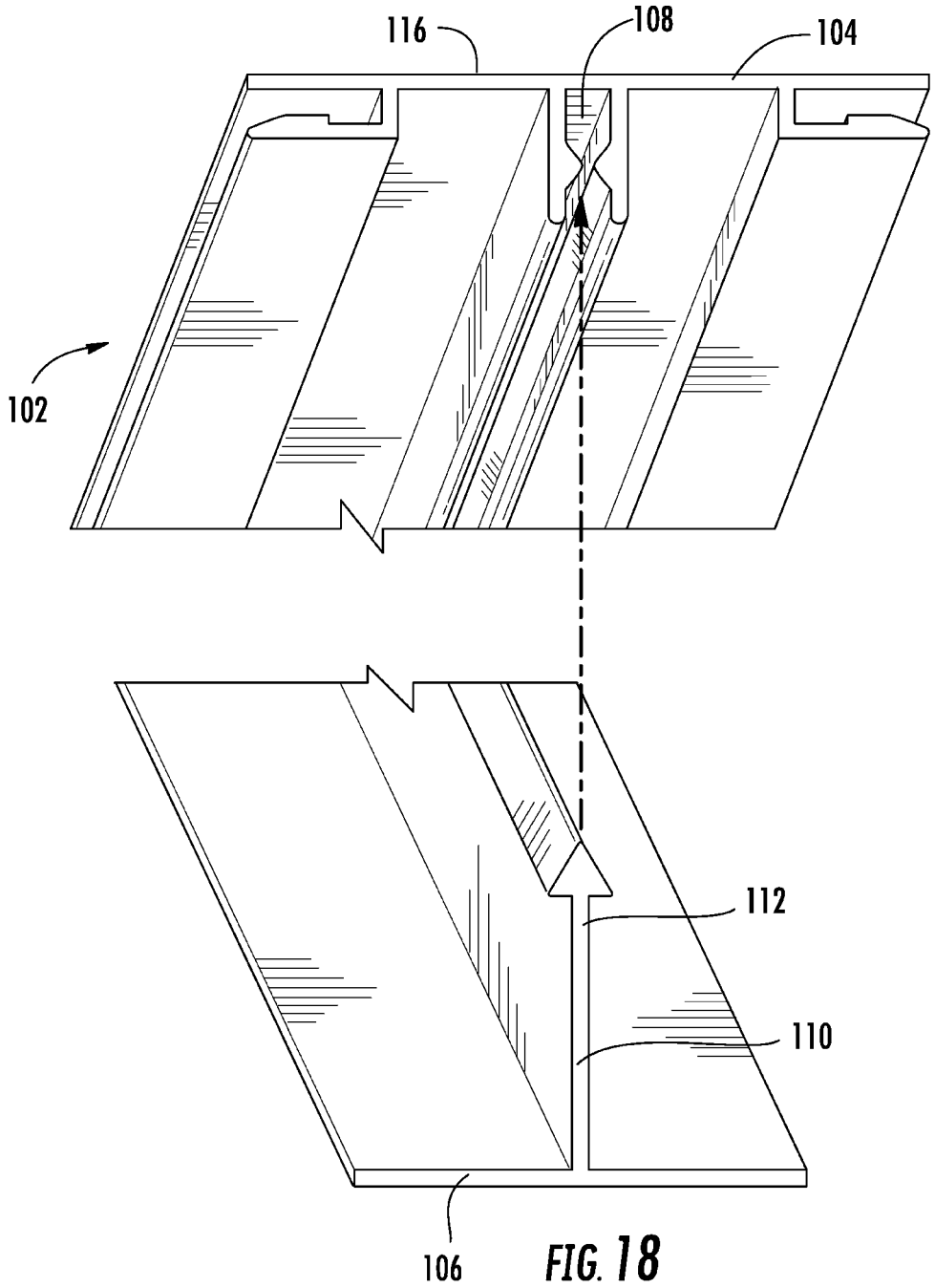
FIG. 18 shows a snap-connector supporting rail, according to an exemplary embodiment.
Figure 19A:
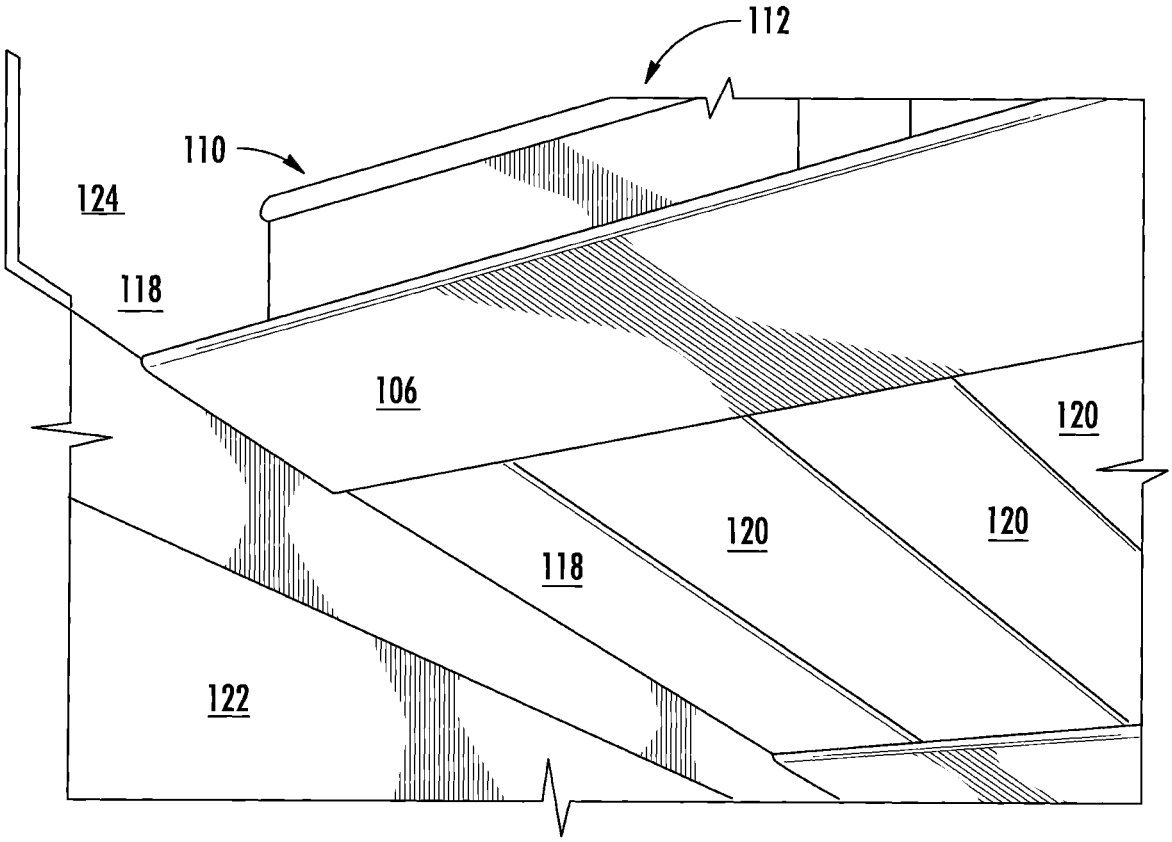
FIG. 19A is a schematic of the snap-connector supporting rail of FIG. 18 in an L-shaped cross-section, with an upward facing wall trim, according to an exemplary embodiment.
Figure 19B:
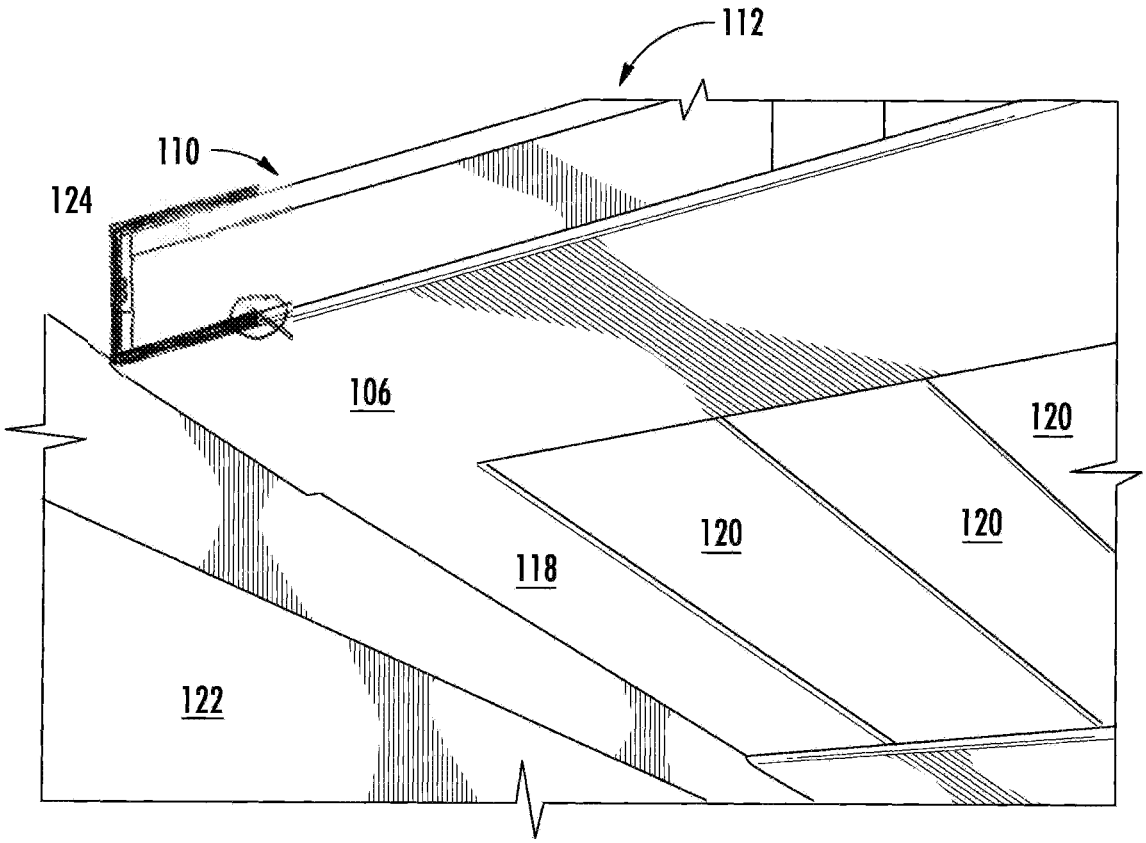
FIG. 19B is a schematic of the snap-connector supporting rail of FIG. 18 in a C-shaped cross-section, with an upward facing wall trim, according to an exemplary embodiment.
Figure 20:
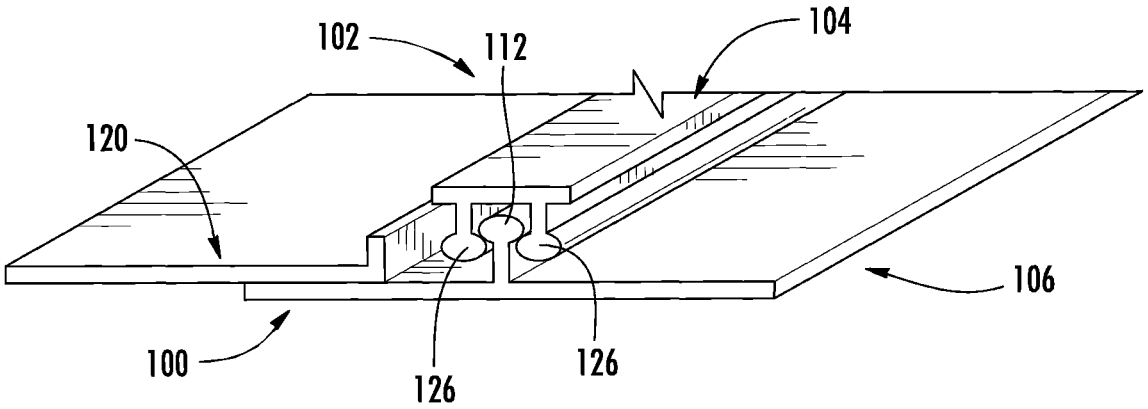
FIG. 20 is an illustration of the assembled snap-connector supporting rail of FIG. 18 supporting a ceiling panel or tile, according to an exemplary embodiment.

FIGS. 18-20 illustrate another embodiment of a drop ceiling 100 that includes a snap connector supporting rail 102. Snap rail 102 includes a connection portion 104 coupled to a supporting portion 106 that together form a snap rail 102 that is the same as or similar to support rail 12, except for the differences described. In contrast to support rail 12, support rail 102 is attached to a bottom of the joist and coupled to supporting portion 106 to form supporting snap rail 102.

FIG. 18 shows features of connecting portion 104 oriented over supporting portion 106. Connecting portion 104 includes a central slot 108 that extends along center portion 104 in a generally central location. Supporting portion 106 includes a projection 110 with one or more detents 112 configured to snap, or releasably securely fasten to central slot 108 of connecting portion 104. When connected, connecting and supporting portions 104 and 106 form an I-shaped snap rail 102. Connecting portion 104 couples the snap rail 102 to a joist with one or more attachments 114, adhesives, nails, staples, and/or screws that couple or fasten connecting portion 104 to the joist. A base 116 of connecting portion 104 is secured against joist and the central slot 108 of connecting portion 104. As illustrated in FIG. 18, connecting portion 104 and supporting portion 106 are separated along a snap joint formed by positioning detent 112 on projection 110 inside central slot 108.

FIG. 19A illustrates the supporting portion 106 of snap rail 102 that functions in the same, or substantially the same way as a hang rail 30 of support rail 12. Also shown in FIG. 19A is a wall trim 118. Wall trim 118 is substantially the same or similar as wall trim 16, except for the differences described. Wall trim 118 is oriented to create a seamless joint between snap rail 102 and ceiling tiles 120 against a wall 122. In some embodiments, wall trim 118 is an L-shaped, C-shaped, or T-shaped bracket with an attachment member 124 coupled to wall 122 above drop ceiling 100 formed with snap rail 102 and ceiling tiles 120. In other embodiments, wall trim 118 is C-shaped, as shown in FIG. 19B. C-shaped wall trim 118 includes a portion of snap rail 102 and/or supporting portion 106 inserted within or butted up to C-shaped (or L-shaped or T-shaped) wall trim 118, e.g., in a flush and/or secured fashion.

FIG. 20 shows connecting portion 104 and supporting portion 106 in a coupled configuration, e.g., where detent 112 of supporting portion 106 is snapped within central slot 108 of connecting portion 104. As shown in FIG. 20, detents 112 are located on both projection 110 and legs 126 of the central slot 108. Similarly, in other configurations, supporting portion 106 includes a slot 108 and connecting portion 104 includes a projection 110 with one or more detents 112. Similar snap fastening configurations include, snap fasteners, button and clips, magnets, adhesives, and/or Velcro. The embodiment of FIG. 20, facilitates rapid and secure attachment of connecting portion 104 to joist and quick connection of supporting portion 106 to form a complete snap rail 102.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in viewing of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A continuous rail drop ceiling system comprising:

a plurality of support rails supportable in parallel to each other and relative to a building structure, each support rail including a plurality of rail sections including:

an elongated cover extending between first and second ends along a central longitudinal axis, the elongated cover having a width extending between first and second channels, and the first and second channels extend parallel to the longitudinal axis between the first and second ends;

a first hanger rail having a first cross-section defined by a first leg engaged and slidable within the first channel and a second leg perpendicular to the first leg;

a second hanger rail having a second cross-section substantially the same as the first cross-section wherein the first leg of the second hanger is engaged and slidable within the second channel and a second leg of the second hanger is parallel to the second leg of the first hanger;

a second elongated cover same as the elongated cover; and a planar joint connector engageable with respective first and second channels of the elongated covers of the adjacent ends of rail sections located such that the central longitudinal axes of the elongated covers are aligned in a collinear orientation, wherein the channels of the elongated covers each include a ceiling panel support surface adjacent and perpendicular to a respective second leg of a respective hanger.

2. The system of claim 1, wherein the second legs include openings configured to accept a support leg which supports the respective support rail relative to the building structure.

3. The system of claim 2, wherein the second legs of at least one of the first and second hanger rails include a longitudinal engagement formation extending along the length of the second legs, the system further comprising a plurality of elongated spacer members extending between the first and second ends, each member including a first engagement channel at the first end and a second engagement channel spaced from the first engagement channel at a predetermined distance between parallel support rails.

4. The system of claim 3 further comprising a plurality of ceiling panels extending along a panel longitudinal axis extending between first and second panel ends each panel having a U-shaped cross section defined by a planar portion extending between parallel legs parallel to the panel longitudinal axis and perpendicular to a flat portion, the panels being supportable at the panel ends by respective panel support surfaces of the respective elongated covers.

5. The system of claim 4, further comprising an adhesive for adhering the legs of adjacent ceiling panels together.

6. The system of claim 5, wherein the adhesive is a double sided tape.

7. The system of claim 4, wherein the ceiling panels are fabricated from one of a group of wood, aluminum, steel or plastic.

8. The system of claim 2 wherein the second legs of adjacent hanger rails contact each other.

9. The system of claim 1, further including wall trim sections for supporting the rails and ceiling panels, the wall trim sections having one of an L-shaped, C-shaped, or T-shaped cross-section with a first portion of the trim attaching to a wall to which the drop ceiling extends and a second portion of the trim receives a female slot on an end of the rail and ceiling panel portions.

10. The system of claim 1 attached to floor joists having a width and height wherein the second legs of the hanger rails are spaced such that a joist is positionable between the second legs and the second legs are fastenable directly to the joist such that ceiling panels are supported between the floor joists and above a bottom of such joists.

11. A drop ceiling installed between interior walls of a building to define the drop ceiling of an interior volume, comprising:

a plurality of support rails having a generally T-shaped cross section having a first flange and a central flange having hanger openings and an engagement flange;

a plurality of hangers supporting the plurality of support rails relative to the building;

a plurality of elongated rail spacers each including a first flange engager and a second flange engager, the rail spacers being spaced along, and perpendicular to, adjacent support rails and engaged with respective first and second flange engagers to maintain a parallel and consistent spacing between adjacent support rails; and a plurality of ceiling panels supported between adjacent support rails by respective first and second engager flanges such that ceiling panels adjacent to the rail spacers are located between the rail spacers and the first and second engager flanges to prevent visibility of the rail spacers from within the interior volume.

12. The ceiling of claim 11 wherein the ceiling panels have a U-shaped cross section defined by a planar portion extending between parallel legs parallel to the panel longitudinal axis and perpendicular to a flat portion.

13. The ceiling of claim 12, further comprising an adhesive for adhering the legs of adjacent ceiling panels together.

14. The ceiling of claim 13, wherein the adhesive is a double sided tape.

15. The ceiling of claim 14, further including wall trim sections for supporting the rails and ceiling panels, the wall trim sections having one of an L-shaped, a C-shaped, or a T-shaped cross-section with a first portion of the trim attaching to a wall to which the drop ceiling extends and a second portion of the trim engaged by rail ends and ceiling panel portions.

16. The ceiling of claim 11, wherein the ceiling panels are fabricated from one of a group of wood, aluminum, steel or plastic.

17. A drop ceiling installed between interior walls of a building to define the drop ceiling of an interior volume, comprising:

a plurality of support rails supported parallel to each other and relative to a building structure, each support rail including a plurality of rail sections including:

an elongated cover extending between first and second ends along a central longitudinal axis, the elongated cover having a width defined by parallel interior facing first and second channels which extend parallel to the longitudinal axis between the first and second ends;

a first hanger rail having a first cross-section defined by a first leg engaged and slidable within the first channel and a second leg perpendicular to the first leg;

a second hanger rail having a second cross-section substantially the same as the first cross-section wherein the first leg of the second hanger is engaged and slidable within the second channel and a second leg of the second hanger is parallel to the second leg of the first hanger, wherein the rail sections are configured to be attached to floor joists having a width and height wherein the second legs of the hanger rails are spaced such that a joist is positioned between the second legs such that the second legs are fastened directly to the joist;

a second elongated cover same as the elongated cover;

a planar joint connector engaged with respective first and second channels of the elongated covers of the adjacent ends of rail sections located such that the central longitudinal axes of the elongated covers are aligned in a collinear orientation, wherein the channels of the elongated covers each include a ceiling panel support surface adjacent and perpendicular to a respective second leg of a respective hanger; and a plurality of ceiling panels extending along a panel longitudinal axis extending between first and second panel ends each panel having a U-shaped cross section defined by a planar portion extending between parallel legs parallel to the panel longitudinal axis and perpendicular to a flat portion, the panels being supported at the panel ends by respective panel support surfaces of respective elongated covers between the joists and above a bottoms of the joists.

18. The system of claim 17, further comprising a click spacer for adhering the legs of adjacent ceiling panels together.

19. The system of claim 18, further including wall trim sections for supporting the rails and ceiling panels, the wall trim sections having one of an L-shaped, C-shaped, or T-shaped cross-section with a first portion of the trim attaching to an a wall to which the drop ceiling extends and a second portion of the trim engaged by rail ends and ceiling panel portions.

20. The system of claim 17, wherein the ceiling panels are fabricated from one of a group of wood, aluminum, steel or plastic.

* * * * *